US006542080B2

(12) United States Patent
Page

(10) Patent No.: US 6,542,080 B2
(45) Date of Patent: Apr. 1, 2003

(54) MONITORING DEVICE TO PREVENT SEPARATION

(76) Inventor: Phillip R. Page, 717 W. 65th St., Westmont, IL (US) 60559

( * ) Notice: Subject to any disclaimer, the term of this patent is extended or adjusted under 35 U.S.C. 154(b) by 0 days.

(21) Appl. No.: 09/871,842

(22) Filed: Jun. 1, 2001

(65) Prior Publication Data

US 2002/0126012 A1 Sep. 12, 2002

Related U.S. Application Data

(60) Provisional application No. 60/210,678, filed on Jun. 10, 2000.

(51) Int. Cl.[7] ..... G08B 13/14

(52) U.S. Cl. ..... 340/571; 340/573.1; 340/573.4; 340/825.36; 340/825.49

(58) Field of Search ..... 340/571, 825.36, 340/825.49, 815.56, 311.1, 982, 539, 573.1, 573.4, 573.3, 7.22; 379/68; 455/134

(56) References Cited

U.S. PATENT DOCUMENTS 5,402,104 A * 3/1995 Larosa ..... 340/539
5,640,147 A * 6/1997 Chek et al. ..... 340/573.1
5,650,770 A * 7/1997 Schlager et al. ..... 340/573.1
5,805,981 A * 9/1998 Sugio et al. ..... 455/38.4
6,114,950 A * 9/2000 Schaible et al. ..... 340/435
6,313,733 B1 * 11/2001 Kyte ..... 340/7.22

* cited by examiner

*Primary Examiner*—Daryl Pope
(74) *Attorney, Agent, or Firm*—Goldstein & Lavas, P.C.

(57) ABSTRACT

A monitoring device to prevent separation including a transmitter portion adapted for coupling with a person or object to be monitored. A receiver portion is provided that is adapted for being worn on a person. The receiver portion is in communication with the transmitter portion. The receiver portion has a predetermined separation parameter measured between the receiver portion and the transmitter portion. The receiver portion includes the ability to determine the distance between the receiver portion and the transmitter portion. The receiver portion includes an alarm for sounding once the predetermined separation parameter has been exceeded. The transmitter portion also includes an alarm for startling a would-be wrongdoer and alerting others near the object of person being monitored.

7 Claims, 4 Drawing Sheets

MONITORING DEVICE TO PREVENT SEPARATION

CROSS REFERENCES AND RELATED SUBJECT MATTER

This application relates to subject matter contained in provisional patent application serial No. 60/210,678, filed in the United States Patent Office on Jun. 10, 2000.

BACKGROUND OF THE INVENTION

The present invention relates to a monitoring device to prevent separation and more particularly pertains to a device which sounds an alarm once a predetermined distance has been reached between two people or objects.

The use of electronic communication devices is known in the prior art. More specifically, electronic communication devices heretofore devised and utilized for the purpose of communicating messages are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,598,272 to Cox discloses an electronic monitoring system for persons, pets or articles, comprised of a pair of devices with audible alarming means when a threshold condition is met, such as reduced signal strength resulting from separation distance. U.S. Pat. No. 5,661,460 to Sallen discloses a system comprised of a series of child transceivers, units and a parent unit, capable of generating an alarm when a predetermined distance is reached. U.S. Pat. No. 5,646,593 to Hughes discloses a child proximity detector, capable of communicating messages. U.S. Pat. No. 5,650,770 to Schlager discloses a compressive remotely monitoring system.

While these devices fulfill their respective, particular objective and requirements, the aforementioned patents do not describe a monitoring device to prevent separation for sounding an alarm once a predetermined distance has been reached between two people or objects.

In this respect, the monitoring device to prevent separation according to the present invention substantially departs from the conventional concepts and designs of the prior art, and in doing so provides an apparatus primarily developed for the purpose of sounding an alarm once a predetermined distance has been reached between two people or objects.

Therefore, it can be appreciated that there exists a continuing need for a new and improved monitoring device to prevent separation which can be used for sounding an alarm once a predetermined distance has been reached between two people or objects. In this regard, the present invention substantially fulfills this need.

SUMMARY OF THE INVENTION

In the view of the foregoing disadvantages inherent in the known types of electronic communication devices now present in the prior art, the present invention provides an improved monitoring device to prevent separation. As such, the general purpose of the present invention, which will be described subsequently in greater detail, is to provide a new and improved monitoring device to prevent separation which has all the advantages of the prior art and none of the disadvantages.

To attain this, the present invention essentially comprises a transmitter portion adapted for coupling with a person or object to be monitored. A receiver portion is provided that is adapted for being worn on a person. The receiver portion is in communication with the transmitter portion. The receiver portion has a predetermined separation parameter measured between the receiver portion and the transmitter portion. The receiver portion includes means for determining the distance between the receiver portion and the transmitter portion. The receiver portion includes an alarm for sounding once the predetermined separation parameter has been exceeded. Further, an alarm may also sound at the transmitter to startle a would-be wrongdoer and alert others surrounding the person or object being monitored.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved monitoring device to prevent separation which has all the advantages of the prior art electronic communication devices and none of the disadvantages.

It is another object of the present invention to provide a new and improved monitoring device to prevent separation which may be easily and efficiently manufactured and marketed.

It is a further object of the present invention to provide a new and improved monitoring device to prevent separation which is of durable and reliable construction.

An even further object of the present invention is to provide a new and improved monitoring device to prevent separation which is susceptible of a low cost of manufacture with regard to both materials and labor, and which accordingly is then susceptible of low prices of sale to the consuming public, thereby making such a monitoring device to prevent separation economically available to the buying public.

Even still another object of the present invention is to provide a new and improved monitoring device to prevent separation for sounding an alarm once a predetermined distance has been reached between two people or objects.

It is yet a further object of the invention to sound an additional alert at the transmitter, so as to warn the would-be wrongdoer of its presence, and warn those surrounding the person or object being monitored.

It is yet a further object of the invention that in the case of a person being monitored, the transmitter is configured so that it is not easily removed. Accordingly, the transmitter housing has a closed loop on its rear surface, and has a belt which extends through the closed loop. The belt has a security double buckle which prevents the would-be wrongdoer from easily removing the transmitter from the person.

Lastly, it is an object of the present invention to provide a new and improved monitoring device to prevent separation including a transmitter portion adapted for coupling with a person or object to be monitored. A receiver portion is provided that is adapted for being worn on a person. The receiver portion is in communication with the transmitter portion. The receiver portion has a predetermined separation parameter measured between the receiver portion and the transmitter portion. The receiver portion includes means for determining the distance between the receiver portion and the transmitter portion. The receiver portion includes an alarm for sounding once the predetermined separation parameter has been exceeded.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to FIGS. 1 through 5 thereof, the preferred embodiment of the new and improved monitoring device to prevent separation embodying the principles and concepts of the present invention and generally designated by the reference number 10 will be described.

Specifically, it will be noted in the various Figures that the device relates to a monitoring device to prevent separation for sounding an alarm once a predetermined distance has been reached between two people or objects. In its broadest context, the device consists of the transmitter portion and a receiver portion. Such components are individually configured and correlated with respect to each other so as to attain the desired objective.

Figure 1:
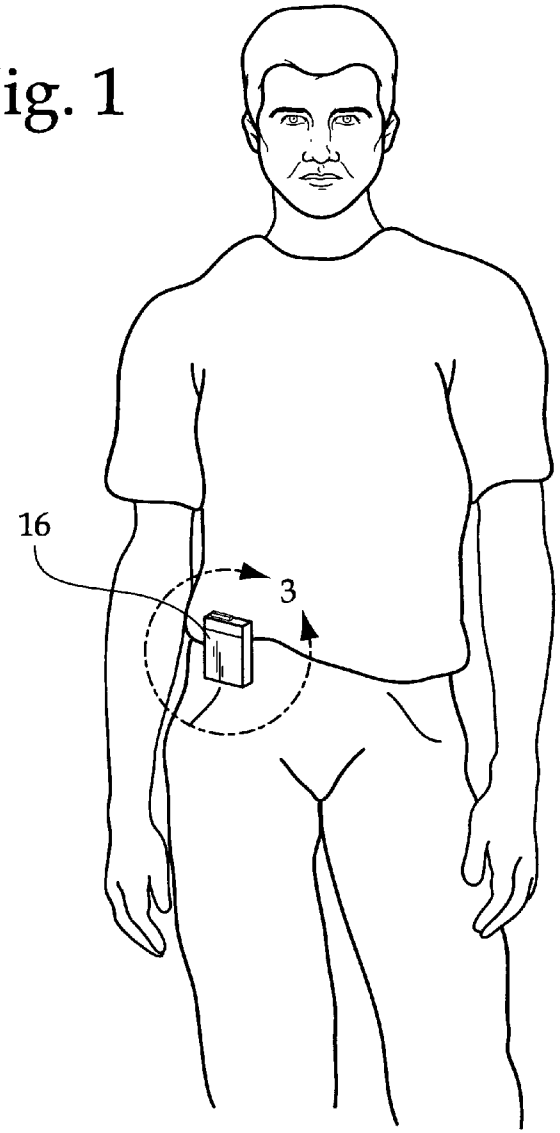
FIG. 1 is a perspective view of the preferred embodiment of the monitoring device to prevent separation constructed in accordance with the principles of the present invention.
Figure 2:
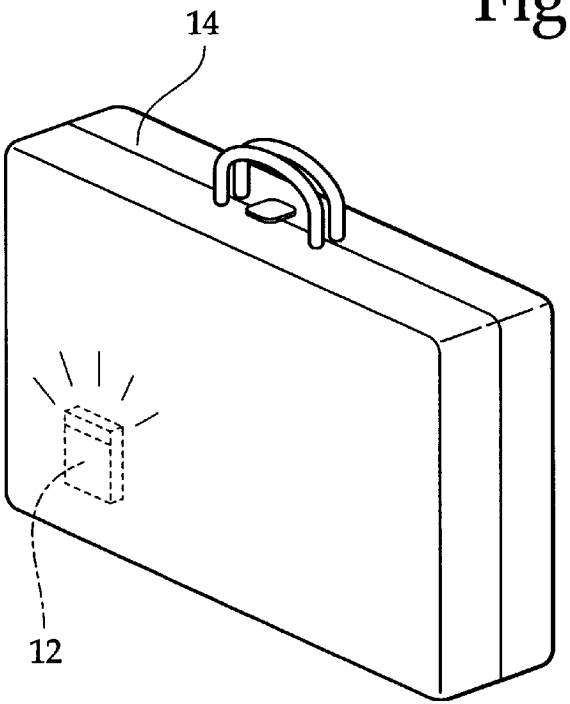
FIG. 2 is a perspective view of the transmitter of the present invention illustrated in use within a briefcase.
Figure 3:
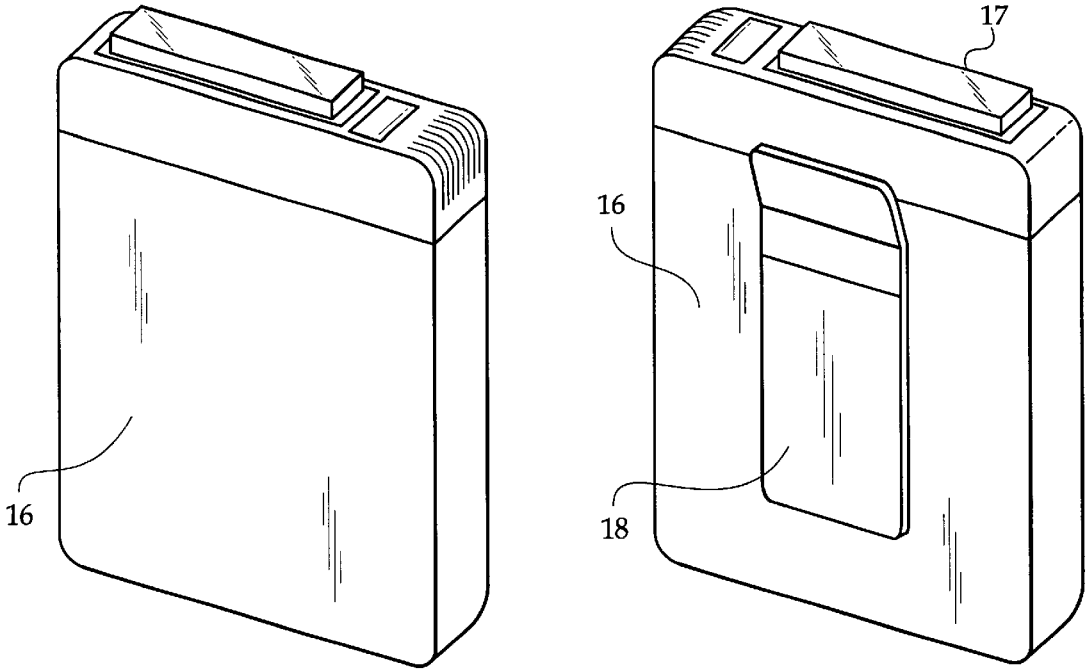
FIG. 3 is a perspective view of pair of receivers of the present invention, showing their front and rear.

The transmitter portion 12 is adapted for coupling with a person or object to be monitored. FIG. 2 illustrates the transmitter portion 12 secured within a briefcase 14. Alternately, the transmitter portion 12 can be secured to a small child or other person to be protected, so as to monitor their location.

The receiver portion 16 is provided that is adapted for being worn on a person. Note FIGS. 1 and 3. The receiver portion 16 resembles a standard pager. The receiver portion 16 is provided with a clip 18 to allow for attachment to an article of clothing. The receiver portion 16 is in communication with the transmitter portion 12, wherein the transmitter 12 has an RF signal generator 32 and the receiver 16 has an RF signal receiver 34. The receiver portion 16 has a predetermined separation parameter measured between the receiver portion 16 and the transmitter portion 12. The receiver portion 16 includes means for determining the distance between the receiver portion 16 and the transmitter portion 12, which includes the RF signal generator 32 and RF signal receiver 34. The receiver portion 16 includes an alarm 30 for sounding once the predetermined separation parameter has been exceeded. Once said predetermined separation parameter has been exceeded, the receiver portion 16 generates a return signal with a return signal generator 36. The transmitter portion 12 also includes a return signal receptor 38 which activates an annunciator 40 that will therefore also sound once the predetermined separation parameter has been exceeded. The alarm can be either audible or vibrating or an option can be provided to select between one of these two modes. The receiver portion 16 includes a reset switch 17 to allow its alarm to be turned off so as to listen for the alarm of the transmitter portion 12. A cancel switch 19 on the receiver portion 16 may be provided to allow the annunciator 40 the transmitter portion 12 to be turned off, possibly through the generation of a discrete signal by the return signal generator 36. The transmitter portion 12 does not have a reset button, thus since it cannot be easily removed from the child of object being monitored, nor can the alarm be shut off without the receiver portion 16, the kidnapper or thief will likely let go of the child or item so as not to draw attention to himself.

In use, the transmitter portion 12 will be attached to either a person or an object to be protected. Once a distance between the transmitter portion 12 and the receiver portion 16 has been exceeded, the alarm 30 will sound the receiver portion 16 and transmitter portion 12, to alert the parent or other care giver. In addition, the annunciator 40 will sound an alert at the transmitter portion 12.

Figure 4:
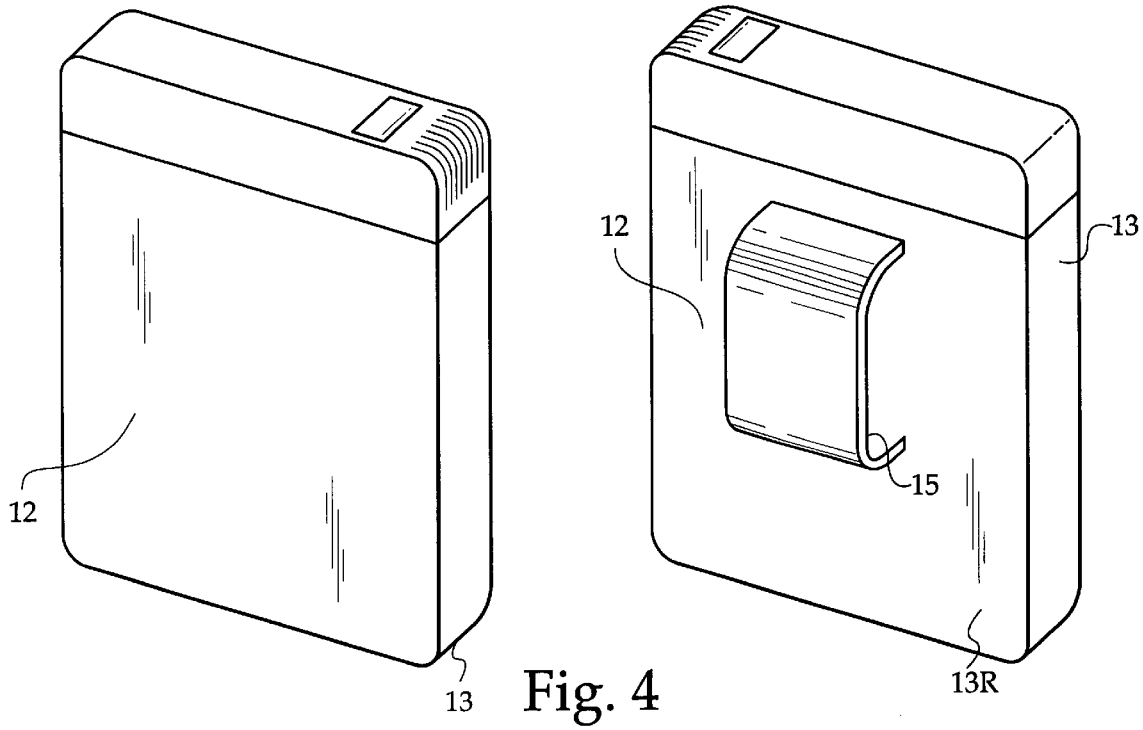
FIG. 4 is a perspective view of the receiver of the present invention.
Figure 5:
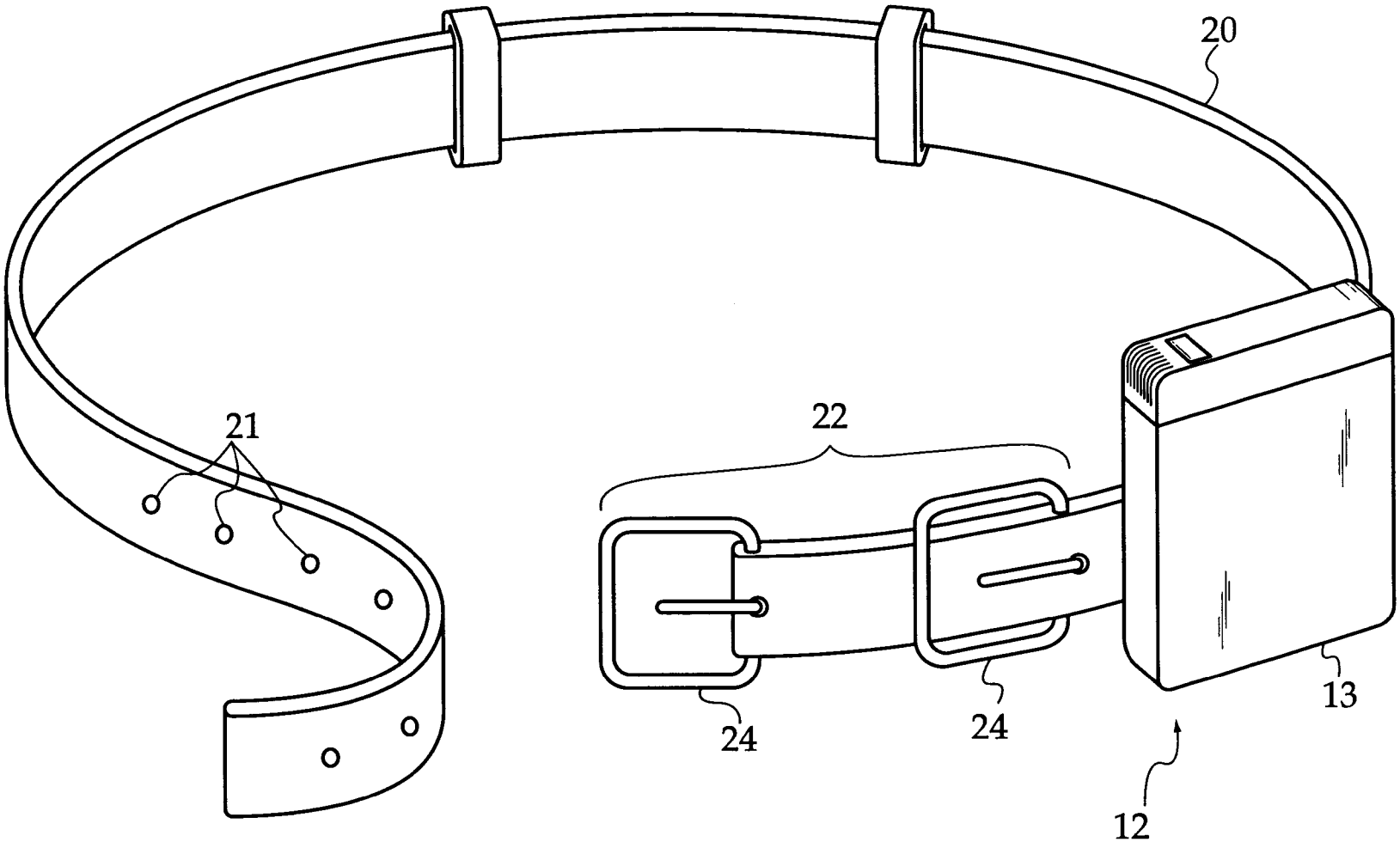
FIG. 5 is a diagrammatic perspective view of the belt used in conjunction with the transmitter housing to secure the transmitter to a person.
Figure 6:
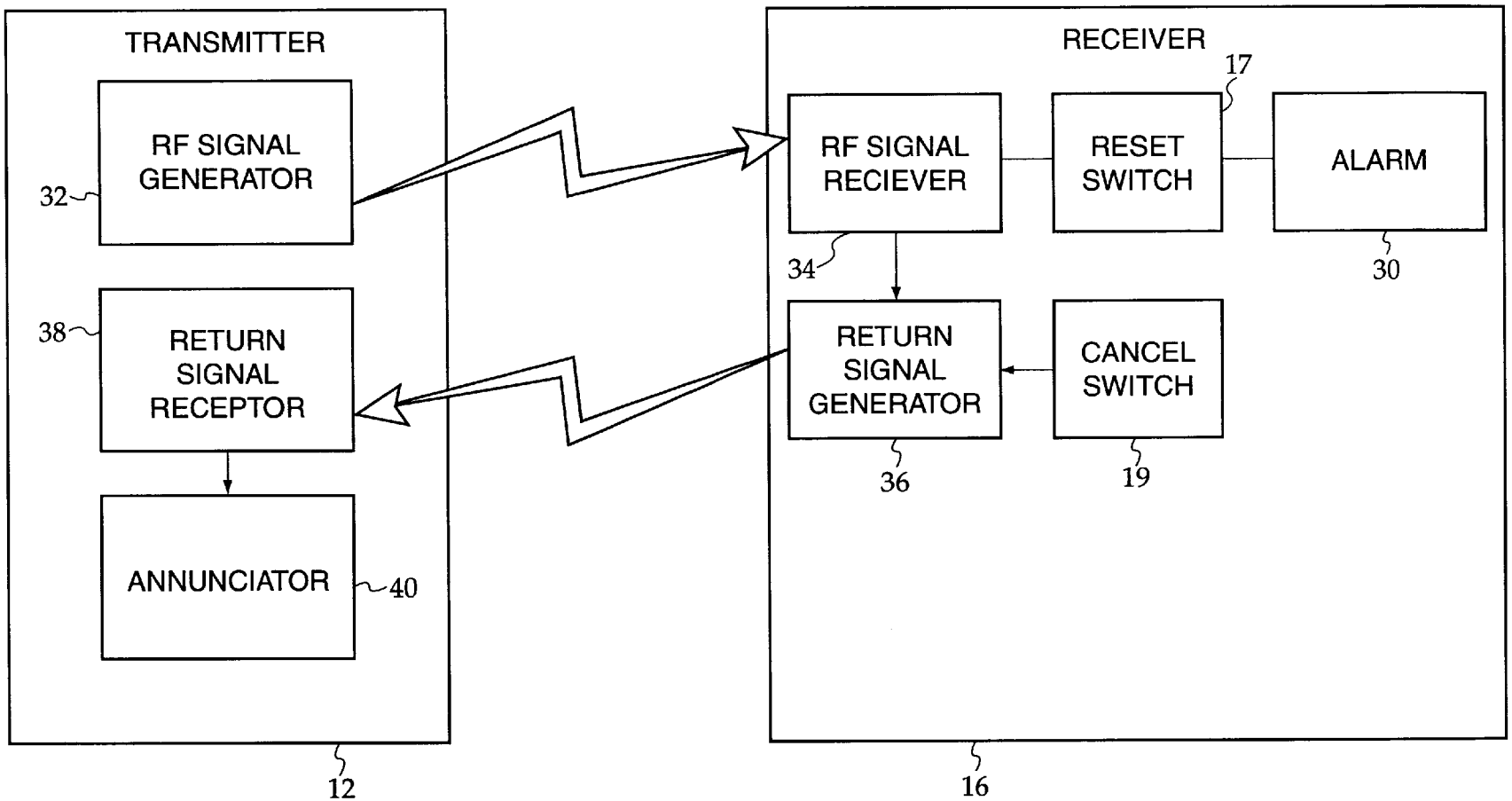
FIG. 6 is a block diagram, illustrating functional interconnection of various components of the invention.

Referring to FIGS. 4 and 5, the transmitter portion 12, includes a transmitter housing 13 which has a transmitter housing rear 13R. A closed loop 15 is located on the transmitter housing rear 13R. According to a preferred embodiment of the invention, the transmitter portion 12 includes a belt 20 which is sized to fit through the closed loop 15 on the transmitter housing rear 13R. The belt 20 has a plurality of evenly spaced belt holes 21. The belt 20 includes a double buckle 22, which includes two discrete buckles 24, which are each capable of engaging the belt holes 21. With the belt 20 extending through the closed loop 15, the belt is secured around the person to be protected. The double buckle 22 is secured. Accordingly, for a would-be wrongdoer to remove the transmitter housing 13 from the person, the belt would first need to be removed, which would involve carefully disengaging each of the discrete buckles 24. It would be quite difficult to disengage both buckles 24, especially if the protected person is squirming or is otherwise being non-cooperative.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A monitoring device to prevent separation, for sounding an alarm once a predetermined distance has been reached between two people or objects comprising, in combination:

a transmitter portion adapted for coupling with a person or object to be monitored;

a receiver portion adapted for being worn on a person, the receiver portion being in communication with the transmitter portion, the receiver portion having a predetermined separation parameter measured between the receiver portion and the transmitter portion, the receiver portion including means for determining the distance between the receiver portion and the transmitter portion, the receiver portion including an alarm for sounding once the predetermined separation parameter has been exceeded, the transmitter portion also including an annunciator for sounding once the predetermined separation parameter has been exceeded, the receiver portion including a reset button for reseting the alarm sounding at said receiver.

2. The monitoring device as recited in claim 1, wherein the receiver has a return signal generator which provides a signal in response to the predetermined separation parameter being exceeded, wherein the transmitter has a return signal receptor which activates the annunciator at the transmitter in response to said signal, and wherein the receiver has a cancel switch for causing the annunciator at the transmitter to stop sounding.

3. The monitoring device as recited in claim 2, wherein the transmitter includes a transmitter housing having a transmitter housing rear, a closed loop is located at the transmitter housing rear, and wherein the transmitter further includes a belt for extending through the closed loop, and extending around the person to be protected.

4. The monitoring device as recited in claim 3, wherein the belt has belt holes, and wherein the belt has a double buckle, comprised of two discrete buckles which are each capable of engaging the belt holes.

5. A monitoring device to prevent separation, for sounding an alarm once a predetermined distance has been reached between two people, comprising in combination:

a transmitter portion adapted for coupling with a person or object to be monitored, the transmitter portion including a transmitter housing having a transmitter housing rear, a closed loop is located at the transmitter housing rear, and wherein the transmitter further includes a belt for extending through the closed loop, and extending around the person to be protected; and a receiver portion adapted for being worn on a person, the receiver portion being in communication with the transmitter portion, the receiver portion having a predetermined separation parameter measured between the receiver portion and the transmitter portion, the receiver portion including means for determining the distance between the receiver portion and the transmitter portion, the receiver portion including an alarm for sounding once the predetermined separation parameter has been exceeded, the transmitter portion also including an annunciator for sounding once the predetermined separation parameter has been exceeded, the receiver portion including a reset button for reseting the alarm sounding at said receiver.

6. The monitoring device as recited in claim 5, wherein the belt has belt holes, and wherein the belt has a double buckle, comprised of two discrete buckles which are each capable of engaging the belt holes.

7. The monitoring device as recited in claim 6, wherein the receiver has a return signal generator which provides a signal in response to the predetermined separation parameter being exceeded, wherein the transmitter has a return signal receptor which activates the annunciator at the transmitter in response to said signal, and wherein the receiver has a cancel switch for causing the annunciator at the transmitter to stop sounding.

* * * * *